US009915082B2

(12) United States Patent
Garneau

(10) Patent No.: US 9,915,082 B2
(45) Date of Patent: Mar. 13, 2018

(54) CAM LATCH

(71) Applicant: Southco, Inc., Concordville, PA (US)

(72) Inventor: Gregory Gilbert Garneau, Berlin, NJ (US)

(73) Assignee: SOUTHCO, INC., Concordville, PA (US)

( * ) Notice: Subject to any disclaimer, the term of this patent is extended or adjusted under 35 U.S.C. 154(b) by 382 days.

(21) Appl. No.: 14/535,790

(22) Filed: Nov. 7, 2014

(65) Prior Publication Data

US 2016/0130840 A1 May 12, 2016

(51) Int. Cl.

| | |
|---|---|
| ***E05C 3/06*** | (2006.01) |
| ***E05B 47/00*** | (2006.01) |
| ***E05B 47/06*** | (2006.01) |
| ***E05B 65/46*** | (2017.01) |
| *E05C 3/00* | (2006.01) |
| *E05B 83/18* | (2014.01) |
| *E05C 3/24* | (2006.01) |

(52) U.S. Cl.

CPC ..... *E05B 47/0012* (2013.01); *E05B 47/0607* (2013.01); *E05B 65/46* (2013.01); *E05B 83/18* (2013.01); *E05B 2047/002* (2013.01); *E05B 2047/0024* (2013.01); *E05B 2047/0067* (2013.01); *E05B 2047/0068* (2013.01); *E05B 2047/0069* (2013.01); *E05B 2047/0086* (2013.01); *E05C 3/24* (2013.01)

(58) Field of Classification Search

CPC ..... E05B 47/0012; E05B 2047/0067; E05B 2047/0069

USPC ..... 292/201, 279, 280

See application file for complete search history.

(56) References Cited

U.S. PATENT DOCUMENTS

| | | | | |
|---|---|---|---|---|
| 4,073,170 A * | 2/1978 | Miyabayashi | ..... | E05B 83/16 292/216 |
| 5,007,261 A | 4/1991 | Quantz | | |
| 5,238,274 A * | 8/1993 | Becker | ..... | E05B 81/06 292/201 |

(Continued)

FOREIGN PATENT DOCUMENTS

| | | |
|---|---|---|
| EP | 1391573 | 2/2004 |
| GB | 2112443 | 7/1983 |

OTHER PUBLICATIONS

EMKA Beschlagteile GmbH & Co. KG, "Electronic Locking System, Program 3000, Single point latch with Integrated status contact," 2014 (1 page).

(Continued)

*Primary Examiner* — Carlos Lugo

(74) *Attorney, Agent, or Firm* — RatnerPrestia

(57) ABSTRACT

A latch for capturing a striker includes a latch cam, a trigger, a drive cam, a motor coupled to the drive cam, and a switch coupled to the motor. The latch cam is biased to rotate toward an open position and configured to capture the striker in a closed position. The drive cam uses at least one cam surface to contact the trigger, and the switch permits actuation of the motor to rotate the drive cam when sensing the trigger or the drive cam, thereby rotating the drive cam to urge the trigger toward an unlocked position, disengage the trigger from the latch cam, and allow the latch cam to rotate from the closed position toward the open position. A system incorporating the latch and method of capturing a striker is also provided.

21 Claims, 13 Drawing Sheets

(56) References Cited

U.S. PATENT DOCUMENTS 5,273,324 A * 12/1993 Kobayashi ..... E05B 81/20 292/201
5,802,894 A * 9/1998 Jahrsetz ..... E05B 77/48 292/144
5,938,252 A * 8/1999 Uemura ..... E05B 81/14 292/201
5,938,253 A * 8/1999 Szablewski ..... E05B 81/14 292/201
6,027,148 A * 2/2000 Shoemaker ..... E05B 47/0002 292/201
6,089,626 A * 7/2000 Shoemaker ..... E05B 47/0002 292/201
6,155,124 A * 12/2000 Wirths ..... E05B 81/14 292/201
6,522,095 B2 * 2/2003 Kachouh ..... E05B 81/14 292/169
6,565,131 B2 * 5/2003 Roos ..... E05B 81/14 292/201
6,659,515 B2 * 12/2003 Raymond ..... E05B 81/20 292/201
7,156,430 B2 * 1/2007 Hidding ..... E05B 85/02 292/216
7,780,204 B2 8/2010 Garneau
8,328,299 B2 12/2012 Hashemi et al.
8,496,275 B2 * 7/2013 Garneau ..... E05B 47/0012 292/144
8,533,998 B2 * 9/2013 Nishikibe ..... E05B 81/14 49/280
8,672,368 B2 3/2014 Grosdemouge
2004/0113438 A1 * 6/2004 Kachouh ..... E05B 81/14 292/201
2005/0035669 A1 2/2005 Bares
2005/0146144 A1 * 7/2005 Brose ..... E05B 81/14 292/201
2008/0087054 A1 4/2008 Hoffmann
2008/0252083 A1 * 10/2008 Carabalona ..... E05B 81/14 292/49
2009/0235767 A1 9/2009 Garneau

OTHER PUBLICATIONS

Kongjin, "Electronic Rotary Latch," retrieved on Aug. 10, 2015 from <http://www.kongjin.co.kr/eng/eng_prod/e.html> (1 page).
SOUTHCO, "R4-EM Electronic Rotary Latch, Electronic Access," Product Literature Pamphlet, 4 pages, Nov. 2011.
SOUTHCO, "R7-EM Outdoor Electronic Rotary Latch, Electronic Access," Product Literature Pamphlet, 4 pages, Jan. 2013.
SOUTHCO, "R4 EM Light Duty Electronic Rotary Latch, Electronic Access," Product Literature Pamphlet, 4 pages, Jun. 2011.
SOUTHCO, "R4 Rotary Latch, Mini, Concealed, Single and Two Stage," NA Handbook 59, pp. 122-129.
International Search Report and Written Opinion of the International Searching Authority for International Application No. PCT/US2015/059489 dated Feb. 5, 2016.
International Preliminary Report on Patentability and Written Opinion for International Application No. PCT/US2015/059489, dated May 9, 2017, 10 pages.

* cited by examiner

CAM LATCH

FIELD OF THE INVENTION

The present invention relates to the field of latch assemblies.

BACKGROUND OF THE INVENTION

Latch assemblies are relied on in many applications for securing items such as panels, doors, and doorframes together. For example, containers, cabinets, closets, drawers, compartments and the like may be secured with a latch. One type of latch assembly includes a rotary pawl or cam, which remains open until the pawl or cam impinges on a bolt. The relative displacement of the assembly with respect to the bolt causes the rotary pawl or cam to rotate and capture the bolt.

In many applications an electrically operated latch is desirable due to the need for remote or push-button entry, coded access, key-less access, or monitoring of access. Various latches for panel closures have been employed where one of the panels, such as a swinging door, drawer or the like, is to be fastened or secured to a stationary panel, doorframe, cabinet, or compartment body.

There is therefore a need for new rotary pawl or cam latch assemblies that include the option of electrical operation having a simpler and cost-effective design.

SUMMARY OF THE INVENTION

One aspect of the present invention provides a latch for capturing a striker that may comprise a latch cam, a trigger, a drive cam, a motor coupled to the drive cam, and a switch coupled to the motor. The latch cam may be mounted to rotate between a closed position and an open position and may be biased to rotate toward the open position and configured to capture the striker when in the closed position. The trigger may be mounted to rotate between a locked position and an unlocked position that may be biased by a spring, for example, to rotate toward the locked position and positioned to contact the latch cam when the trigger is in the locked position, thereby retaining the latch cam in the closed position. The drive cam may have at least one cam surface positionable to contact the trigger. The switch may be positioned to detect the trigger when the trigger is in the locked position and to sense the drive cam. The switch may permit actuation of the motor to rotate the drive cam when sensing the trigger or the drive cam, thereby rotating the drive cam to urge the trigger from the locked position toward the unlocked position, disengage the trigger from the latch cam, and allow the latch cam to rotate from the closed position toward the open position.

In another aspect of the invention, the latch may further comprise a housing at least partially enclosing one or more of the latch cam, the trigger, the drive cam, the motor, and the switch.

The trigger may optionally include an extension that extends outside of the housing and is configured such that a force applied to the extension urges the trigger toward the unlocked position. A cable mounting bracket may also be optionally positioned on the housing to receive a cable for attachment to the extension of the trigger. The cam may optionally include a bearing surface to prevent the trigger from returning to the locked position when the cam is in the open position. The latch may also optionally include a sensor, such as a magnetic reed switch, positioned to detect when the striker is captured by the latch cam or when the striker is in proximity to the latch.

In yet another aspect of the present invention, a latch system is provided having a latched configuration and an unlatched configuration and may comprise a latch, as described above, and a striker movable with respect to one another between the latched configuration and the unlatched configuration. In one embodiment, the latch may be stationary and the striker movable with respect to the latch, and in another embodiment, the striker may be stationary and the latch movable with respect to the striker. The striker may have an engagement surface, such as provided by a bolt for example, positioned to be engaged by the latch in the latched configuration. Optionally, the latch status may be indicated based on the state of the switch, an open switch indicating that the latch is not secure and a closed switch indicating that the latch is secure.

In yet another aspect of the present invention, a method for releasing a striker from a latch cam of a latch may comprise:

- sensing the position of a trigger and a drive cam of the latch with a single switch, wherein the sensing step optionally includes contacting the switch with the trigger or the drive cam;
- actuating a motor to rotate the drive cam of the latch while the trigger or the drive cam is sensed by the switch;
- rotating the trigger of the latch from a locked position toward an unlocked position by rotation of the drive cam;
- disengaging the trigger from the latch cam of the latch; and
- allowing the latch cam of the latch to rotate from a closed position toward an open position, by for example biasing the latch cam toward the open position, thereby releasing the striker from the latch cam of the latch.

The method may optionally further comprise sensing when the striker is released from the latch.

DETAILED DESCRIPTION OF THE INVENTION

Figure 1C:
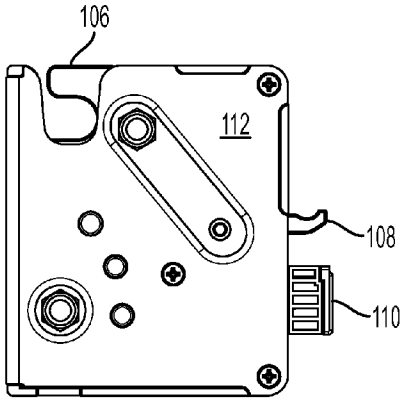
FIG. 1C is a rear view of the first embodiment of the invention.
Figure 1F:
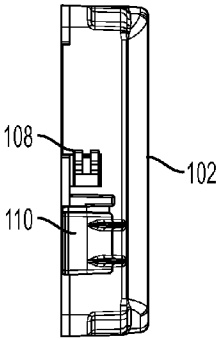
FIG. 1F is a left side view of the first embodiment of the invention.
Figure 1B:
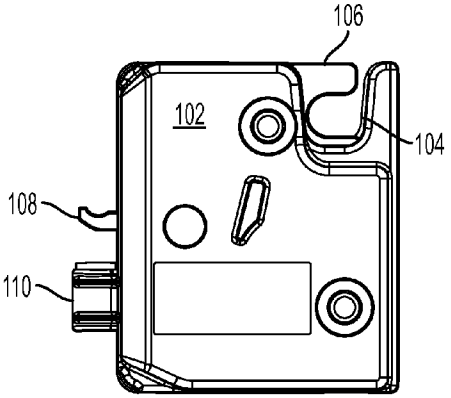
FIG. 1B is a front view of the first embodiment of the invention.
Figure 1E:
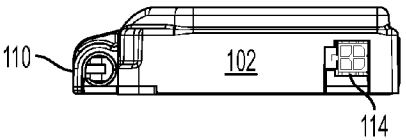
FIG. 1E is a bottom view of the first embodiment of the invention.
Figure 1A:
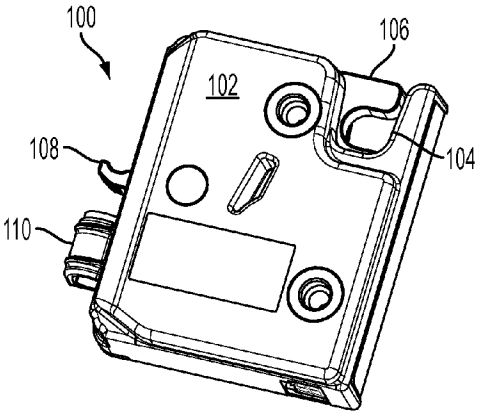
FIG. 1A is a front perspective view of a latch according to a first embodiment of the Invention.
Figure 1D:
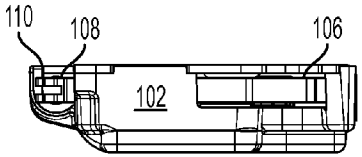
FIG. 1D is a top view of the first embodiment of the invention.
Figure 2C:
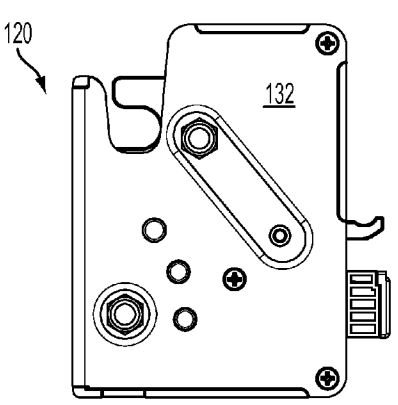
FIG. 2C is a rear view of the second embodiment of the invention.
Figure 2F:
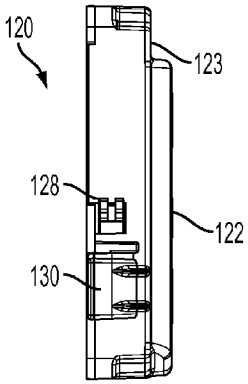
FIG. 2F is a left side view of the second embodiment of the invention.
Figure 2B:
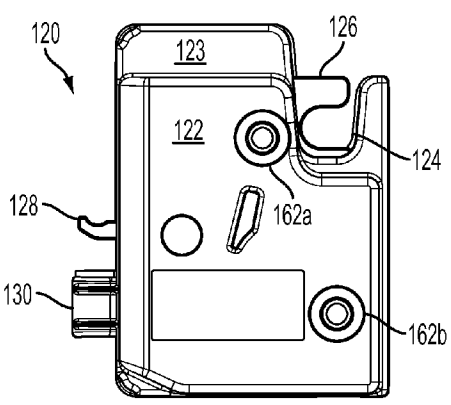
FIG. 2B is a front view of the second embodiment of the Invention.
Figure 2E:
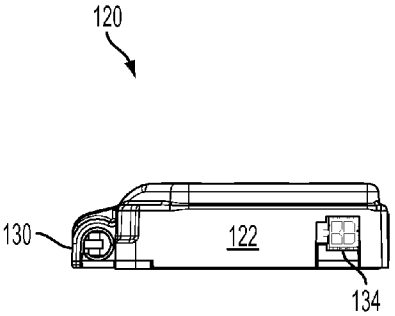
FIG. 2E is a bottom view of the second embodiment of the invention.
Figure 2A:
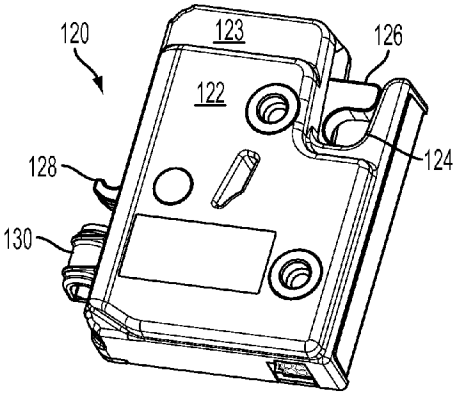
FIG. 2A is a front perspective view of a latch according to a second embodiment of the invention.
Figure 2D:
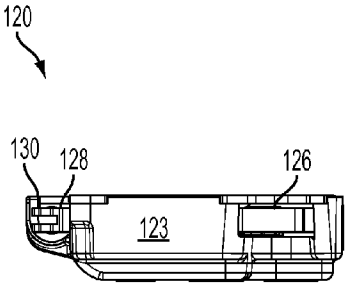
FIG. 2D is a top view of the second embodiment of the invention.

The invention will now be described by reference to exemplary embodiments and variations of those embodiments. Although the Invention is illustrated and described herein with reference to specific embodiments, the invention is not intended to be limited to the details shown and described. Rather, various modifications may be made in the details within the scope and range of equivalents of the claims and without departing from the invention.

Generally, this invention provides a means for capturing a striker, a bolt, a catch, a keeper, or other similar component or structure capable of being captured or otherwise retained by a latch (generically referred to in this description as a striker or latch striker), and for releasing the striker by either the electrical actuation or manual actuation of a trigger. For example, a latch according to one embodiment of the present invention may be actuated manually by directly pulling on a portion of the trigger or remotely pulling on a flexible cable attached to a portion of the trigger. Alternatively for electromechanical operation, an actuator mechanism may push and rotate the trigger upon energizing the mechanism. To secure an object carrying the latch striker, such as a drawer or door, the latch has push to close functionality. The latch may include a latch cam that is spring loaded to the open position and a trigger that is spring loaded to the locked position.

The actuator system is optionally integrated into the assembly of the latch. Also, as will be described later in greater detail, the motor and gears of the latch need not be pre-packaged but instead can be individual components of the final latch assembly. Additionally, electronics need not be used for timing or logic features or for circuit protection, position sensing or motor voltage regulations. For example, a single diode is optionally used in the circuit for reverse polarity protection. Motor control and position sensing of the drive cam and trigger can advantageously be accomplished using a single switch such as an single pole, double throw (SPDT) mechanical micro switch. In other words, the position sensing and motor control of the latch is optionally accomplished with one switch as opposed to using plural switches or sensors; for example, a single switch or sensor, such as an SPDT micro switch, is optionally used to accomplish plural tasks such as for drive cam position sensing, trigger position sensing, and motor current control. And the same switch or sensor is optionally used to provide a latch status output signal for the user.

As will be described in greater detail later, the trigger spring is optionally biased into position by a compression spring, and the trigger can be formed as a single component part. Similarly, the latch cam can be formed as a single component part. Also, the latch is optionally provided with an extended housing to accommodate an optional switch, such as a magnetic reed switch, that can be used to detect if another component, such as a door with a magnet, is present or not.

Referring now to a first embodiment according to the present invention illustrated in FIGS. 1A to 1F, a latch assembly 100 according to one embodiment of the invention includes components, such as a housing 102, a latch cam 106, and a trigger having an extension 108. The housing is configured to have an opening 104 in which a U-shaped portion of the latch cam 106 is exposed. The opening 104 provides a space to receive a latch striker, so that the striker impinges on the latch cam 106 causing the latch cam 106 to rotate to the closed position, as illustrated in FIGS. 1A to 1F, and capture the striker. The latch cam 106 may be maintained in the closed position. In order to release the striker, the extension 108 of the trigger may be manually actuated to allow rotation of the latch cam 106 to the open position.

The bottom of the housing 102 may further include an access point 114 to connect to a circuit board, described in greater detail below. The power supply may be provided through the access point 114. Also, indicators may be electrically connected to the circuit board via the access point 114 to provide information regarding the state of the latch assembly, which will also be described in greater detail below.

Extending from a side of the housing 102 is an optional cable mounting bracket 110. The cable mounting bracket 110 includes a longitudinal opening, so that a flexible cable may be inserted through the longitudinal opening and attached to an end portion of the extension 108. A user may then actuate the trigger from a remote location by pulling on the cable. The use of a cable to remotely actuate a latch mechanism may be desirable in particular applications, for example opening the trunk of an automobile from the driver seat.

A second embodiment of a latch assembly 120 made according to the present invention is illustrated in FIGS. 2A to 2F. The components of the second embodiment are identical to the first embodiment, except that the housing 122 of the second embodiment includes an optional upper portion 123. The upper portion 123 of the housing 122 may house a sensor to indicate whether a door or panel, on which the latch striker is mounted, is in the vicinity of the latch assembly. Such sensors are known by those having skill in the art and may include, for example, a magnetic reed switch. A magnetic reed switch would require a magnet or some magnetic field generating component on the door or panel, so that the magnetic field will cause the magnetic reed switch to close and generate a signal when the striker is in proximity to the latch.

Figure 3B:
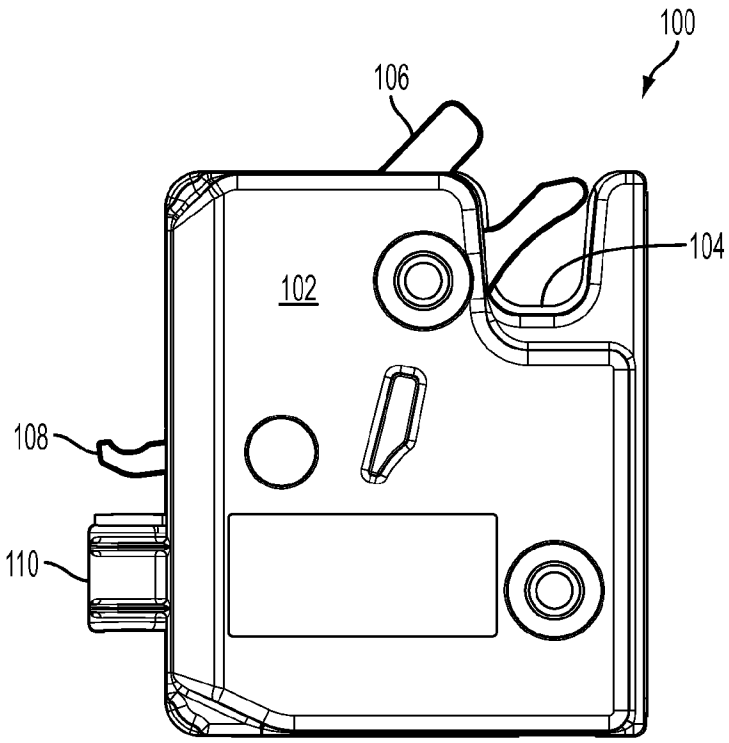
FIG. 3B is a front view of the first embodiment of the invention in which the latch cam is in an open position.
Figure 3A:
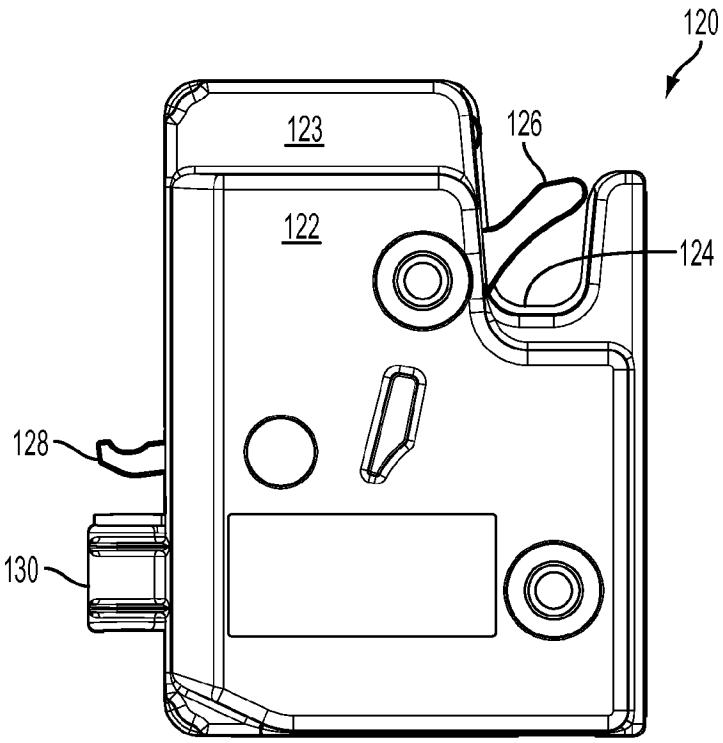
FIG. 3A is a front view of the second embodiment of the Invention in which the latch cam is in an open position.
Figure 4:
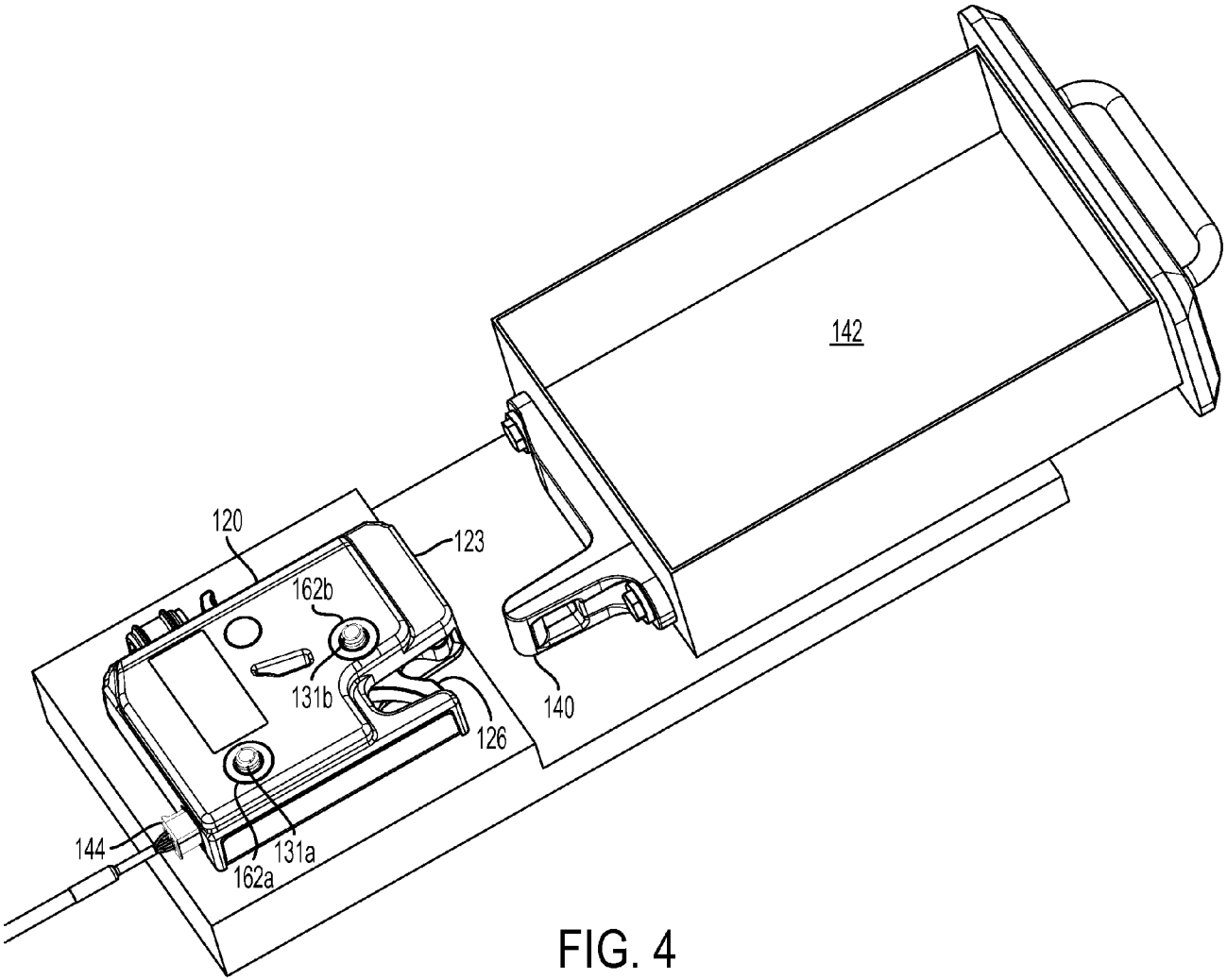
FIG. 4 is front perspective view of a latch system in an unlatched configuration according to an embodiment of the invention, the latch system including the second embodiment of the invention in an Installed condition.

In FIGS. 3A and 3B, the first and second embodiments of the invention are illustrated with the latch cam (106, 126) in the open position, ready to receive a latch striker. FIG. 4 illustrates the second embodiment of a latch assembly 120 in the installed condition. The latch assembly 120 is attached to a panel by inserting at least one fastener 131*a*, 131*b* through a corresponding opening provided by a plurality of pivot pins 162*a*, 162*b*. The latch assembly 120 is oriented such that the latch cam 126 is facing a latch striker 140. The latch striker 140 in this example is attached to the rear of a sliding drawer 142.

The latch cam 126 is illustrated in the open position, so that when the drawer 142 is pushed toward latch cam 126, the latch striker 140 contacts the latch cam 126 causing the latch cam 126 to rotate and capture the striker 140. Once captured, the drawer 142 is locked in position and cannot be pulled away from the latch assembly 120. In order to release the drawer 142, a motor within the latch assembly 120 must be energized through an electrical connection 144 in order to rotate the latch cam 126 back to the open position.

According to one embodiment of the present invention, a means for electrically actuating a latch assembly to the open position is illustrated in FIGS. 5A to 5D. In Figure SA, a rear view of the latch assembly 120 is illustrated similar to FIG. 2C, except that a rear cover 132 has been removed in addition to a gearbox 152. Typically, the rear cover 132 may be attached to the rear of the housing 122 using fasteners, such as a plurality of screws 150*a*, 150*b*, and 150*c*.

Figure 5A:
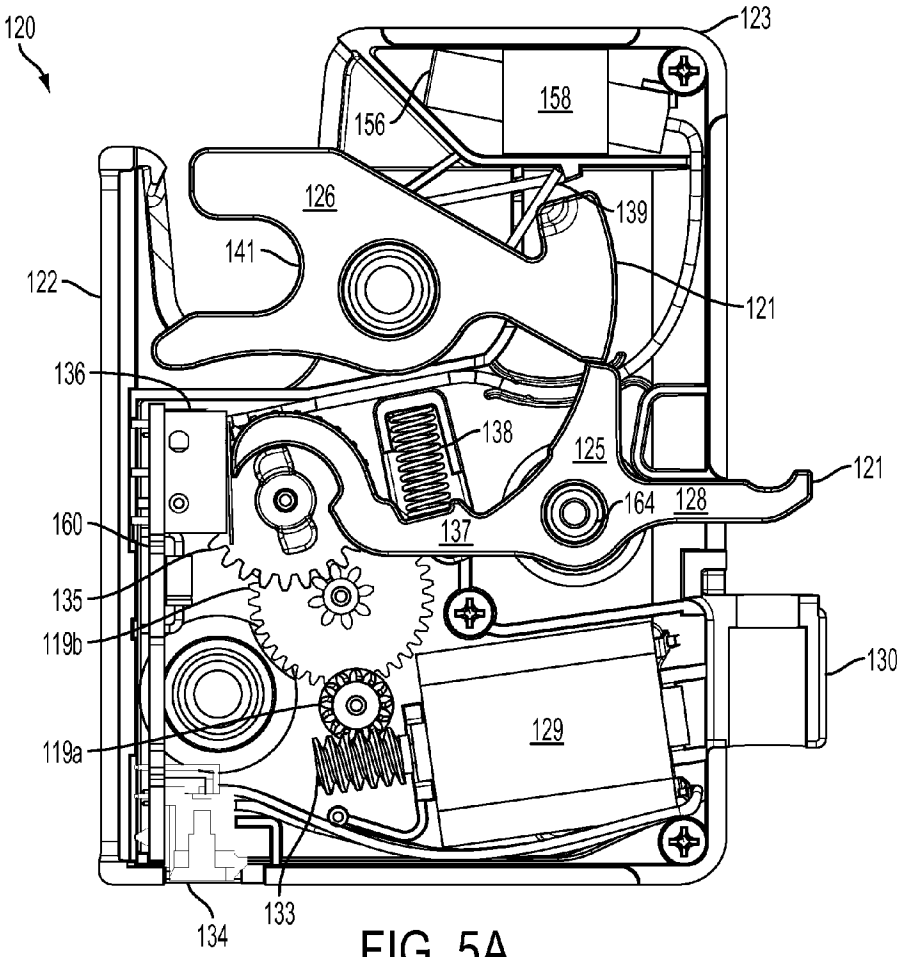
FIG. 5A is a rear view of the second embodiment of the Invention with the rear cover of the housing removed.

The latch cam 126 in FIG. 5A is in a closed position, and it is this position that enables the latch cam 126 to capture a latch striker within the U-shaped retaining surface 141 of the latch cam 126. The latch cam 126 is biased to an open position by a first spring 139, preferably a coil spring. The coil spring 139 will rotate the latch cam 126 in a clock-wise direction as oriented in FIG. 5A. One leg of the coil spring 139 presses against an inner wall of the housing 122, while the second leg presses against a corner 166 of the latch cam 126.

The trigger 121 prevents the latch cam 126 from rotating to the open position because a retaining portion 125 on the trigger 121 provides a blocking surface that contacts an outer portion of the latch cam 126. The trigger 121 is biased to rotate in the counter-clockwise direction about a trigger pivot pin 164. The biasing force is provided by a second spring 138, preferably a compression spring, that bears against an actuator such as arm portion 137 of the trigger 121.

As mentioned above, a magnetic reed switch 156 may be located in the upper portion 123 of the housing 122. The magnetic reed switch 156 is connected to a circuit board 160 to indicate when a door or panel carrying the latch striker is near the latch assembly. A protective foam pad 158 may be loaded into the upper portion 123 of the housing 122 with the magnetic reed switch 156.

The tip of the arm portion 137 of the trigger 121 engages a "Normally Open" switch 136, preferably an SPDT switch, to maintain a closed circuit. Electrical actuation may occur when a voltage is applied between the power and ground connections of the latch connector 144 and the circuit is closed. The circuit is closed when the switch 136 is in the closed position, e.g., when the switch lever is depressed. Preferably, the switch 136 may be mounted on the circuit board 160. A single diode may also preferably be used in the circuit for reverse polarity protection.

When a user wishes to unlatch the assembly 120, the motor 129 may be remotely energized. The motor 129, which may be connected to the circuit board 160, causes a worm gear 133 to rotate, which in turn causes a drive cam 135 to rotate via a series of gears 119*a*, 119*b*. The motor 129, gears 119*a*, 119*b*, and drive cam 135, may be housed within a gearbox 152. The gearbox 152 may also provide locations in which one end of a series of gear shafts 154*a*, 154*b*, and 154*c* reside. The gear shafts 154*a*, 154*b*, 154*c* may be inserted through the gears 119*a*, 119*b* and drive cam 135.

Figure 5B:
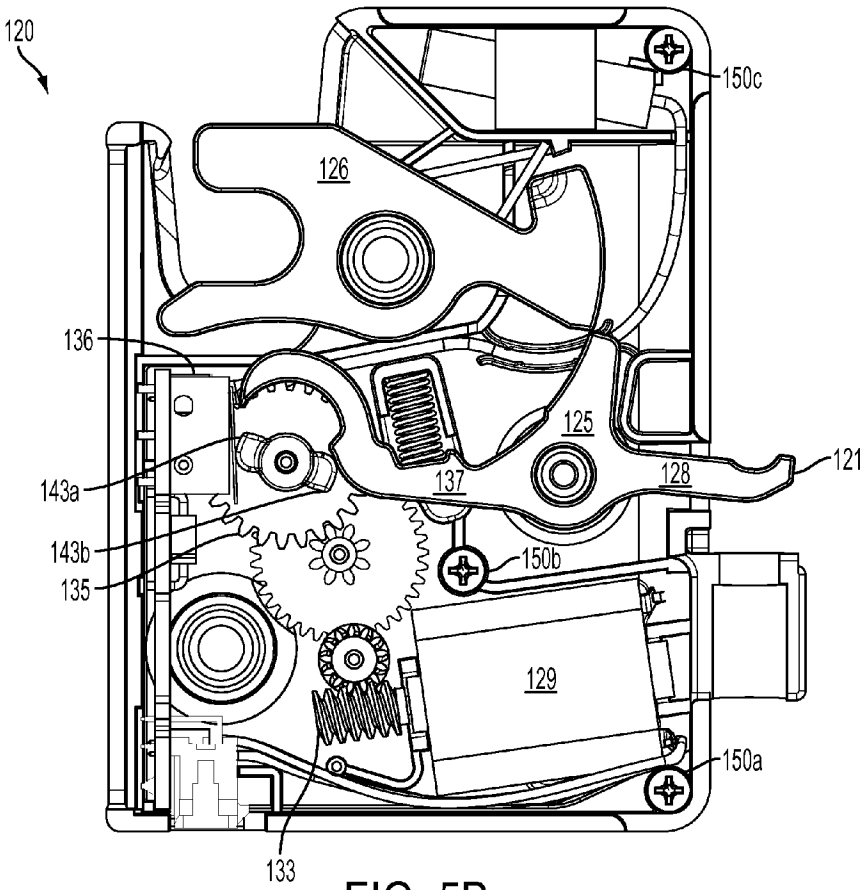
FIG. 5B is a rear view of the second embodiment of the Invention with the rear cover of the housing removed, with the latch in another position.

Referring to FIG. 5B, the drive cam 135 includes two lobes 143*a*, 143*b*, preferably spaced 180 degrees apart. As the drive cam 135 rotates, a cam surface on the first lobe 143*b* contacts the arm portion 137 of the trigger 121 causing the trigger 121 to rotate in a clock-wise direction as shown in the figures. The tip of the arm portion 137 eventually disengages from the switch 136; however, a cam surface on the second lobe 143*a* of the drive cam 135 engages the switch 136 as the trigger 121 rotates.

In order to facilitate the maintenance of the "Normally Open" switch 136 in the closed position during electrical actuation, the end of the arm portion 137 is preferably sickle-shaped to provide space for the sweeping motion of the lobes 143*a*, 143*b* of the drive cam 135. The lobes 143*a*, 143*b* may then assume the function of depressing the switch lever as the end of the arm portion 137 disengages the switch 136 during rotation of the trigger 121. This maintains a closed circuit to deliver a current to the motor 129 when such current is delivered.

Figure 5C:
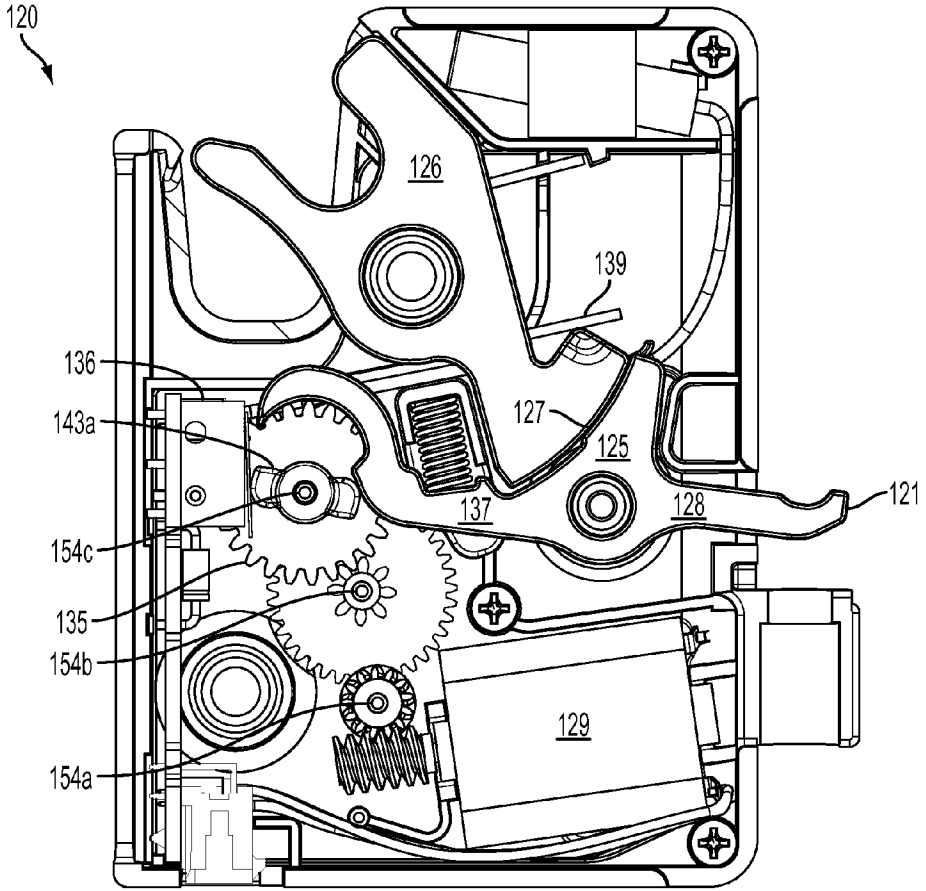
FIG. 5C is a rear view of the second embodiment of the invention with the rear cover of the housing removed, with the latch in another position.

Referring now to FIG. 5C, the degree of rotation of the trigger 121 is sufficient such that the outer portion of the latch cam 126 is no longer blocked by the retaining portion 125. Preferably, the configuration of the trigger 121 and the drive cam 135 is such that only a slight degree of rotation is needed and minimum amount of power is required to effectively remove the trigger 121 as an obstacle to rotation of the latch cam 126. Once free, the coil spring 139 will rotate the latch cam 126 to the open position to release a striker.

Once rotated, a bearing surface 127 of the latch cam 126 will prevent the trigger 121 from rotating in a counter-clock wise direction because the bearing surface 127 will contact and essentially block the retaining portion 125. Because the lobe 143*a* continues to engage the switch 136, the motor 129 will continue to cause the drive cam 135 to rotate.

Figure 5D:
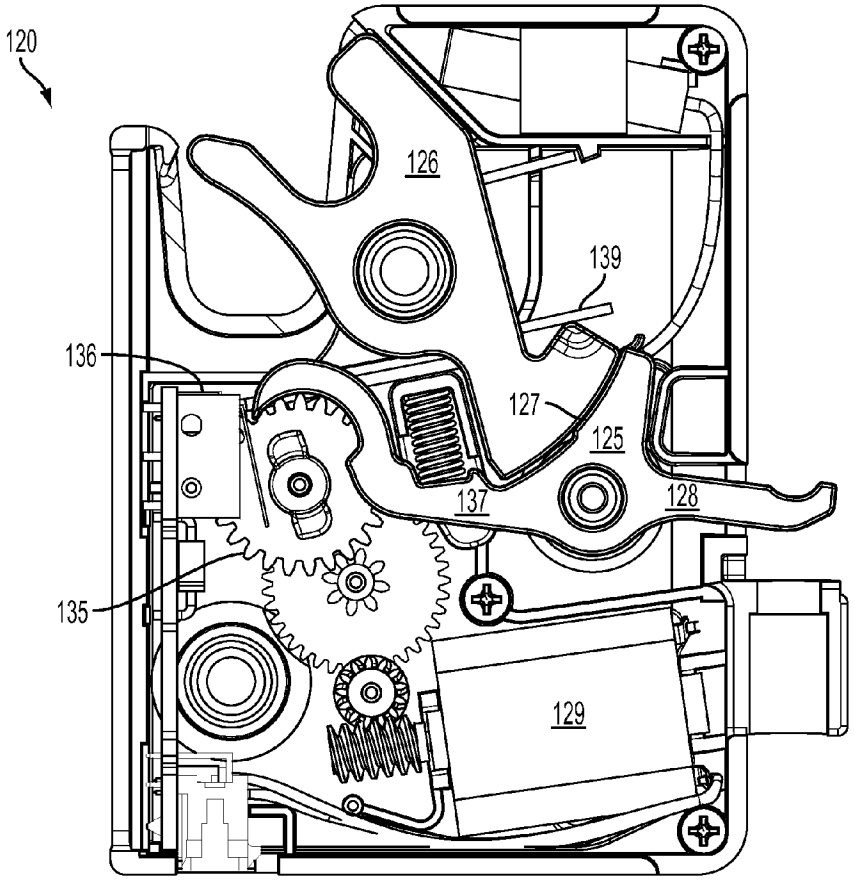
FIG. 5D is a rear view of the second embodiment of the invention with the rear cover of the housing removed, with the latch in another position.
Figure 6:
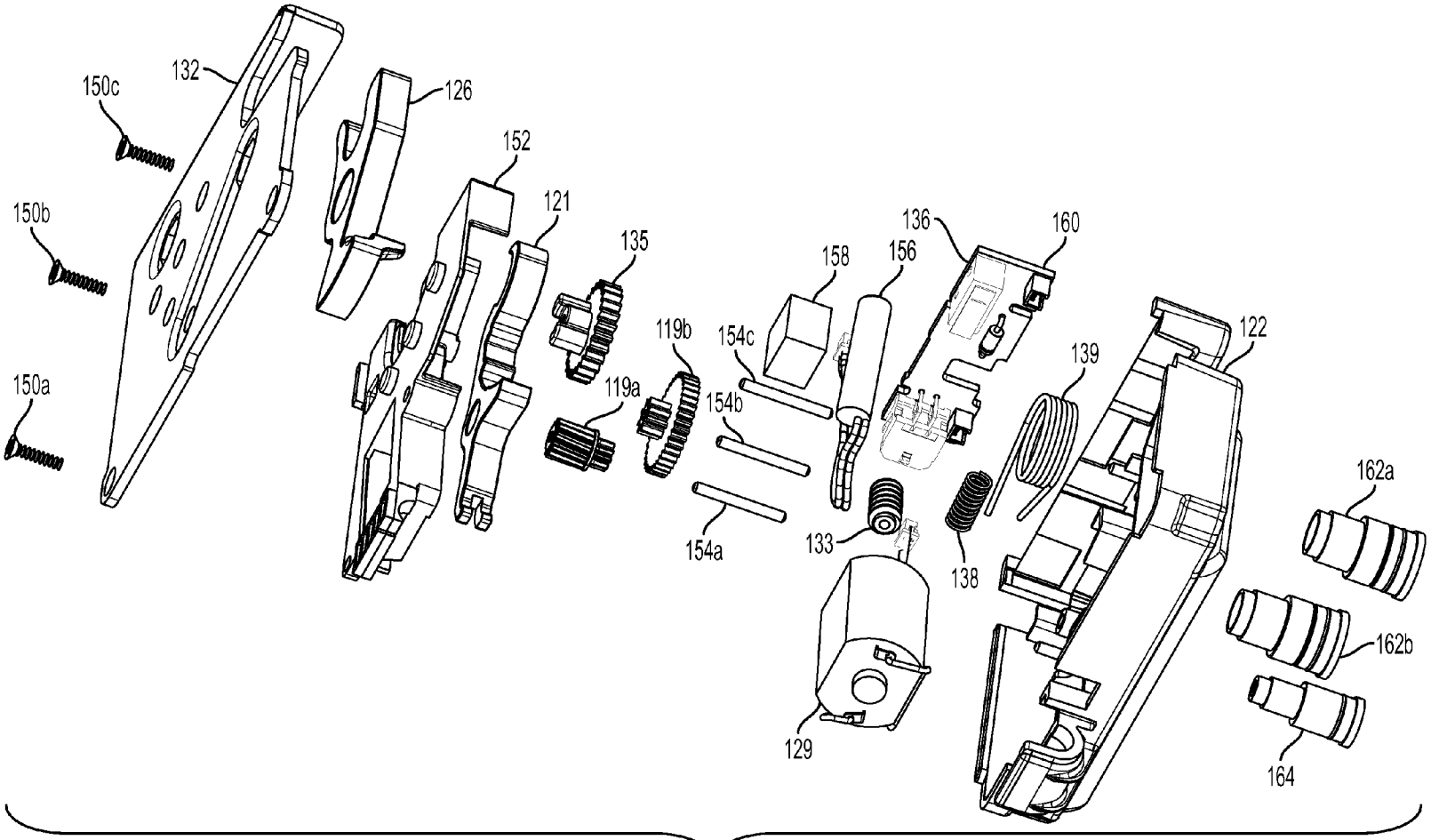
FIG. 6 is an exploded view of the second embodiment of the invention.
Figure 7A:
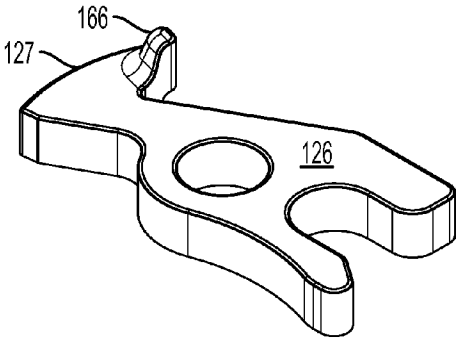
FIG. 7A is a front perspective view of an embodiment of a latch cam that can be incorporated in a latch according to the invention.
Figure 7B:
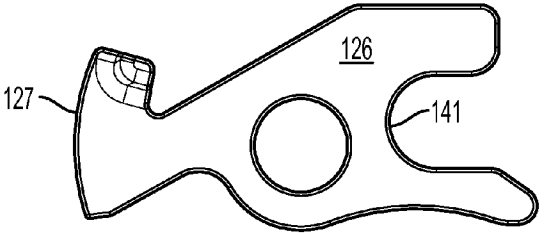
FIG. 7B is a front view of the latch cam of FIG. 7A.
Figure 7C:
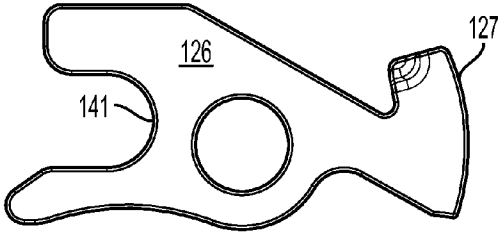
FIG. 7C is a rear view of the latch cam of FIG. 7A.
Figure 7D:
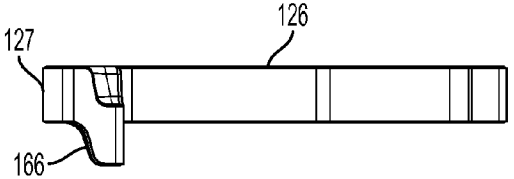
FIG. 7D is a top view of the latch cam of FIG. 7A.
Figure 7E:
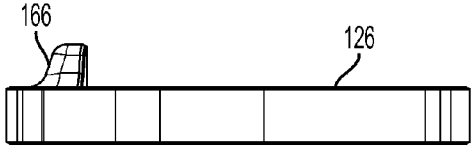
FIG. 7E is a bottom view of the latch cam of FIG. 7A.
Figure 7F:
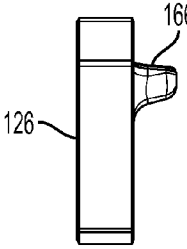
FIG. 7F is a left side view of the latch cam of FIG. 7A.
Figure 7G:
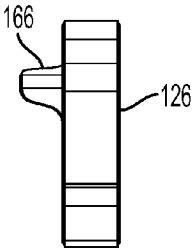
FIG. 7G is a right side view of the latch cam of FIG. 7A.
Figure 8B:
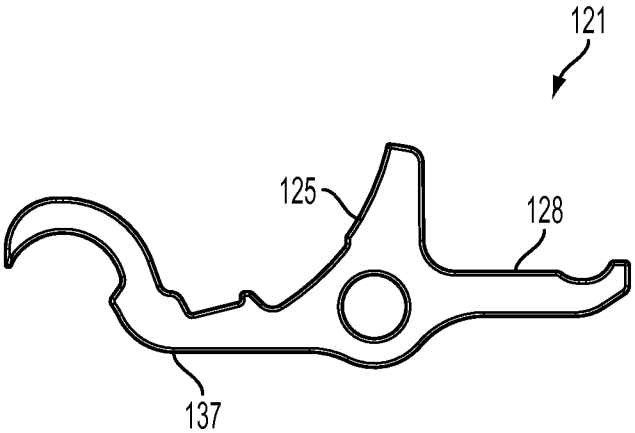
FIG. 8B is a front view of the trigger of FIG. 8A.
Figure 8A:
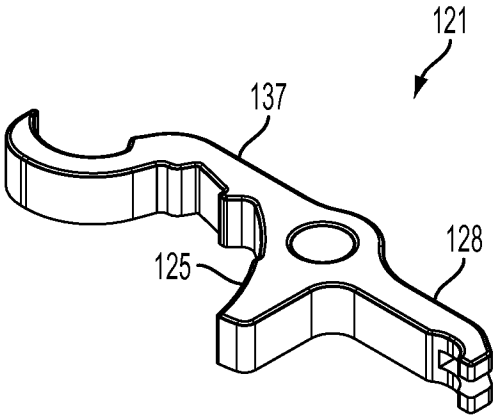
FIG. 8A is a front perspective view of an embodiment of a trigger that can be incorporated in a latch according to the invention.
Figure 9C:
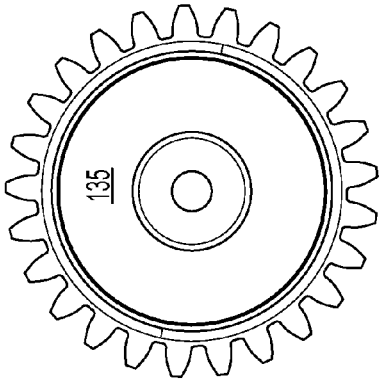
FIG. 9C is a rear view of the drive cam of FIG. 9A.
Figure 9B:
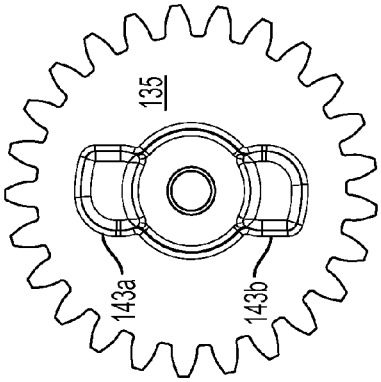
FIG. 9B is a front view of the drive cam of FIG. 9A.
Figure 9A:
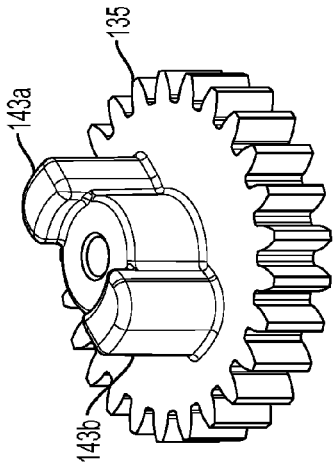
FIG. 9A is a front perspective view of an embodiment of a drive cam that can be incorporated in a latch according to the invention.
Figure 9E:
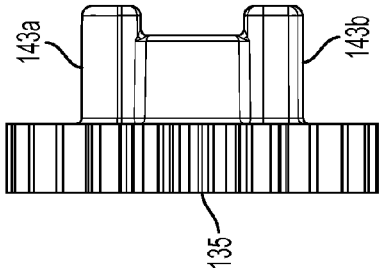
FIG. 9E is a side view of the drive cam of FIG. 9A.
Figure 9D:
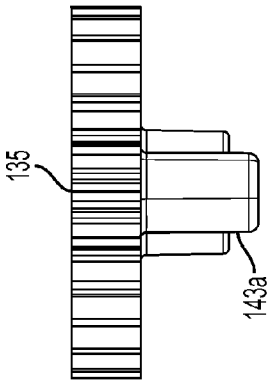
FIG. 9D is a top view of the drive cam of FIG. 9A.

When the drive cam 135 no longer engages the switch 136, the circuit will open and cut the current to the motor 129. As illustrated in FIG. 5D, the drive cam 135 will have rotated approximately 180 degrees when electrical actuation of the latch assembly 120 is complete. The symmetrical design of the drive cam 135 therefore provides for an actuation cycle for every half turn of the drive cam 135.

Electrical power is preferably removed after the drive cam has returned to a starting position and the electrical actuation cycle is complete. If power is not removed, the latch may initiate a new cycle when the latch cam 126 returns to the closed position.

In order to return the latch assembly 120 to the original closed position illustrated in FIG. 5A, a latch striker may impinge on the latch cam 126, causing the latch cam 126 to rotate in a counter-clockwise direction as illustrated in FIG. 5A. Preferably, the latch cam 126 may be configured to over-rotate to accommodate over travel of the latch striker in the closing direction. When the bearing surface 127 no longer blocks the retaining portion 125, the compression spring 138 will cause the trigger 121 to rotate in a counter-clockwise direction until an end surface of the retaining portion 125 is again blocking the outer portion of the latch cam 126 and the tip of the arm portion 137 of the trigger 121 again engages the switch 136, so that the motor 129 may be energized when prompted by a user. The U-shaped retaining surface 141 of the latch cam 126 prevents the latch striker from moving in the opening direction and thus secures the drawer or other object connected to the latch striker.

The latch assembly 120 may also be manually actuated. As explained above, an extension 128 of the trigger 121 extends beyond the housing 122. A flexible cable (not shown) may be optionally fed through a cable bracket 130 and attached to the extension 128. The extension 128 allows a user to either directly or remotely actuate the latch assembly 120. This may be accomplished by manually applying a force by either pushing or pulling the extension 128 to rotate the trigger 121 by a sufficient degree, such that the retaining portion 125 is no longer blocking the latch cam 126. Once free to rotate, the coil spring 139 will rotate the latch cam 126 to the open position, so that the latch striker is no longer captured.

A latch assembly according to the present invention may be controllable by a variety of different types of system controllers, such as magnetic lock/electric strike latching relay type controls, automotive door lock controllers, or a simple switch control. The latch may be simply controlled by applying power for sufficient duration of time and removing power after it has completed a cycle, e.g., a rotation of the drive cam to release the latch cam to the open position. Preferably, only two wires may be required to connect the latch to a power source and control the latch.

Latches according to various embodiments of the present invention may also provide latch status feedback and a door sensing option. For example, as mentioned previously, the position of the trigger may be monitored by a single switch, preferably an SPDT switch, that may also be used to control the motor. In the embodiment illustrated in FIGS. 5A to 5D, the trigger position is dependent on the cam position. If the trigger is in the locked position, the switch is closed, e.g., the switch lever is depressed, and the latch cam is in the closed position and the latch secure. When the trigger is in the unlocked position and the switch is open, the latch cam is in the open position. Therefore, latch status may be indicated based on the state of the switch. An open switch indicates that the latch is not secure, and a closed switch indicates that the latch is secure.

As mentioned above, an optional magnetic reed switch may also be included in embodiments of the present invention to sense and Indicate the presence of a door or panel. The magnetic reed switch may detect the presence of a magnetic field and will provide a closed circuit to ground. A door or panel carrying the latch striker may be equipped with a magnet, or the magnet may be carried by the striker, and when the door or panel is in the closed position, the magnetic reed switch may provide a closed circuit to ground through a door status pin on an electrical connector connected to the latch assembly. The magnetic reed switch will open when the door or panel is moved, and the magnet is far enough away, such that the magnetic reed switch will not sense the magnetic field generated by the magnet.

The methods and materials used to fabricate the components of a latch assembly according to the present invention may be any materials known to those having skill in the art. For example, in some embodiments, a stronger, rugged metal material for the latch cam and trigger may be desired to ensure that the latch mechanism will operate properly for a number of cycles during the lifetime of the latch mechanism. For cost reasons, some embodiments may use a cam and/or trigger made from plastic materials. The various components may be stamped from metal or injection molded from plastic, for example.

Figure 10:
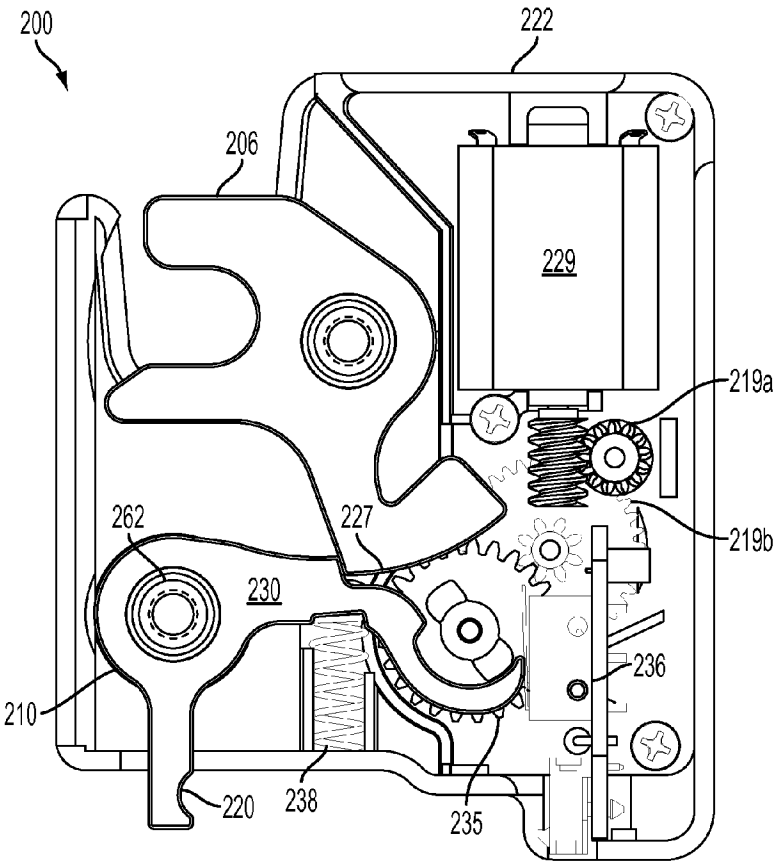
FIG. 10 is a rear view of a third embodiment of the invention with the rear cover of the housing removed.

Variations to the embodiment of the latch mechanism illustrated in FIGS. 5A to 5D may be made without departing from the present invention. For example, another embodiment of the present invention is illustrated in FIG. 10, which provides a latch assembly 200 having a compact design. All of the components of the latch assembly 200 are the same as the second embodiment described above, except for the latch cam 206 and the trigger 210. The location and orientation of the motor 229, gears 219*a*, 219*b*, drive cam 235, switch 236, and compression spring 238 have changed because the location of the trigger 210 has moved.

In the latch assembly 200, a separate pivot pin for the trigger 210 has been eliminated. Instead, the trigger 210 rotates about a pivot pin 262 having a fastener bore for mounting the latch assembly 200 to a panel. The trigger 210 also lacks a separate retaining portion. The blocking surface is instead provided on the arm portion 230, which also contacts the switch 236. Rotating the trigger 210 clockwise, either electrically with the drive cam 235 or manually at the extension 220, will move the blocking surface and permit the latch cam 206 to rotate clockwise to the open position.

In the open position, the bearing surface 227 of the latch cam 206 will contact the arm portion 230 and prevent the compression spring 238 from rotating the trigger 210 in the counter-clockwise direction. The extension 220 of the trigger 210 extends beyond the bottom of the housing 222; however, in other embodiments, the extension 220 may protrude through the side of the housing 222 similar to the first and second embodiments.

Accordingly, latches according to aspects of this invention are electromechanically operated push to close rotary cam latches with mechanical override. As noted, such latches can be offered in two different housing lengths. An extended housing version provides some protection to the cam in the open position, and a standard version that can be shorter in length allows the latch to be closer to another structure such as a door. An option for a magnetic door sensor is optionally provided, for example, in the extended housing version.

Operation of latches according to embodiments of the invention will now be described. Specifically, manual operation will be described first followed by electromechanical operation.

Regarding manual operation, a latch according to embodiments of the this invention can be actuated manually by directly pulling on an exposed portion of a trigger component or remotely by using a flexible cable to pull on the trigger. The latch housing optionally incorporates a mounting feature for mechanical override cables.

A drawer or door or other system component connected to a latch bolt or striker can be secured with the latch. To secure such a component, the latch has push to close (latch) functionality. When the latch mechanism is composed of a rotary cam that is spring loaded to the open position and a rotary trigger that is spring loaded to the locked position, the component such as a drawer can be pushed closed and the latch striker will strike the cam while in the open position and cause it to rotate into the closed position against the torsion spring force on the cam. When the cam is in the closed position, the trigger compression spring applies a force to rotate the trigger to the locked position and the cam is engaged behind the retaining tooth or surface on the trigger. The retaining tooth blocks the motion of the cam in the opening direction. The cam can move slightly in the closing direction to accommodate over travel of the latch striker in the closing direction. In the closed and locked position, the U shape of the cam prevents the latch striker from moving in the opening direction and thus secures the drawer or other component.

From a secure position, an exposed end of a trigger can be moved manually such that it rotates the body of the trigger about the trigger pivot pin until the retaining tooth on the trigger slides past the cam and no longer obstructs the motion of the cam. A bias, such as a torsion spring force on the cam, forces the cam to rotate into the open position and disengages the latch striker.

Regarding electromechanical operation, the latch according to embodiments of the invention can operate electrically when a voltage is applied between a power (Vin) and ground connections of the latch connector and the motor circuit is closed. A motor circuit optionally uses a Normally Open switch contact and is closed when the switch lever is in the closed position.

A sequence of operation according to one exemplary embodiment of the Invention is summarized in the following table:

| POSITION | CONDITIONS |
|---|---|
| Position 1 (latch is secure and ready to operate-see for example FIG. 5A) | Cam closed<br>Trigger locked<br>Drive cam is free<br>Switch is dosed by trigger<br>Motor can operate when power is supplied |
| Position 2 (electrical operation, power is applied) | Cam closed<br>Trigger locked<br>Drive cam rotates and engages trigger<br>Switch closed by trigger<br>Motor operates |
| Position 3 (electrical operation, power is applied) | Cam closed<br>Trigger unlocking<br>Drive cam rotates and engages trigger and switch<br>Switch closed by trigger and drive cam<br>Motor operates |
| Position 4 (electrical operation, power is applied-see for example FIG. 5B) | Cam closed<br>Trigger unlocking<br>Drive cam rotates and engages trigger and switch<br>Switch closed by drive cam<br>Motor operates |
| Position 5 (electrical operation, power is applied-see for example FIG. 5C) | Cam open<br>Trigger unlocked<br>Drive cam rotates and engages trigger and switch<br>Switch closed by drive cam<br>Motor operates |
| Position 6 (electrical operation, power is applied) | Cam open<br>Trigger unlocked<br>Drive cam rotates and engages switch, does not engage trigger<br>Switch closed by drive cam<br>Motor operates |

-continued

| POSITION | CONDITIONS |
|---|---|
| Position 7 (latch is open and ready to be closed with power removed-see for example FIG. 5D) | Cam open<br>Trigger unlocked<br>Drive cam is free, does not engage switch or trigger<br>Switch open (disconnects power to motor)<br>Motor drifts to a stop<br>Electrical power is removed after the electrical operation cycle is complete in order to close the latch. If power is not removed, the latch will initiate a new cycle when it is closed.<br>Manually closing the latch cam (or door or other component) returns the latch to the secure and ready to operate position (Position 1 above). The latch can accommodate some over travel in the closing direction, as noted in Position 8 described below. |
| Position 8 (latch is secure and ready to operate in over travel position) | Cam closed, external dosing force applied for over travel position<br>Trigger locked<br>Drive cam is free<br>Switch is closed by trigger<br>Motor can operate when powered is supplied<br>For electromechanical operation, a small actuator mechanism pushes and rotates the trigger to release the cam/latch. |

As noted in the foregoing table, examples of Positions 1, 4, 5, and 7 are illustrated in FIGS. 5A-5D, respectively. Although the remaining positions listed in the table (namely Positions 2, 3, 6, and 8) are not separately illustrated in the figures, those positions will be understood from the foregoing description.

Regarding the actuator mechanism, it is optionally composed of a SPDT control switch, a small DC motor, a gear train ending with a drive cam and a trigger/actuator arm. The gear train can be composed of a worm press fit onto the motor output shaft, a worm gear/reduction gear, a compound reduction gear, and the driven gear which includes a drive cam that has two identical lobes spaced 180 degrees apart.

One of the drive cam lobes is used as a cam that connects with the switch lever that is used to sense the rotational position of the drive cam for stopping the motor in the correct rotational position for one cycle of 180 degrees. When the drive cam releases the switch lever, the Normally Open contact opens and the motor stops. The other lobe of the cam is used to drive the actuator arm portion of the trigger and thus rotate the trigger for latch release during electrical operation. The trigger position is also sensed or otherwise detected by the switch as the end of the trigger actuator arm contacts the switch lever in the trigger closed position.

Regarding the optional latch status position feedback switch, the position of the trigger can be monitored by the single SPDT switch also used to control the motor. The trigger position is dependent on the cam position; therefore, if the trigger is in the locked position the cam is closed and the latch is secure. There is only one secure possibility in this embodiment. The latch status output from the switch indicates if the latch is secure or not secure. The contact of the switch is used for latch status position feedback. When the trigger is in the locked position, the switch lever is depressed and the contact is open.

The latch is optionally controllable by a variety of different types of system controllers such as magnetic lock/electric strike relay type controls, automotive door lock controllers, or simple switch control. The latch is simply controlled by applying power for sufficient duration of time and removing power after it has completed its cycle. Only two wires are required to operate the latch in such embodiments.

As described previously, an optional magnetic reed switch is included with selected latches. The magnetic switch will detect the presence of a magnetic field and will provide a closed circuit to ground. A door striker can be equipped with a magnet and when the door is in the closed position the magnetic switch will provide a closed circuit to ground through a door status pin on the latch connector. The switch will open when the door is open and the magnet is far away.

While preferred embodiments of the invention have been shown and described herein, it will be understood that such embodiments are provided by way of example only. Numerous variations, changes and substitutions will occur to those skilled in the art without departing from the spirit of the Invention. Accordingly, it is intended that the appended claims cover all such variations as fall within the spirit and scope of the invention.

What is claimed is:

1. A latch for capturing a striker, the latch comprising:

a latch cam mounted to rotate between a closed position and an open position, the latch cam being biased to rotate toward the open position and configured to capture the striker when in the closed position;

a trigger mounted to rotate between a locked position and an unlocked position, the trigger being biased to rotate toward the locked position and positioned to contact the latch cam when the trigger is in the locked position, thereby retaining the latch cam in the closed position;

a drive cam having at least one cam surface positionable to contact the trigger;

a motor coupled to the drive cam;

a switch coupled to the motor via a motor circuit, the switch being in a closed state closing the motor circuit when the trigger is engaged with the switch, the motor being configured for separate actuation when the switch is in the closed state and the motor not being configured for separate actuation when the switch is not in the closed state; and a spring for biasing the trigger toward the locked position of the trigger;

wherein in the closed state of the switch and upon the separate actuation of the motor, the motor rotates the drive cam, thereby urging the trigger from the locked position toward the unlocked position, disengaging the trigger from the latch cam and from the switch with the drive cam engaging the switch to maintain the closed state, and allowing the latch cam to rotate from the closed position toward the open position.

2. The latch of claim 1, further comprising a housing at least partially enclosing one or more of the latch cam, the trigger, the drive cam, the motor, and the switch.

3. The latch of claim 2, wherein the trigger includes an extension that extends outside of the housing and is configured such that a force applied to the extension urges the trigger toward the unlocked position.

4. The latch of claim 3, further comprising a cable mounting bracket positioned to receive a cable for attachment to the extension of the trigger.

5. The latch of claim 1, wherein a bearing surface of the latch cam prevents the trigger from returning to the locked position when the latch cam is in the open position.

6. The latch of claim 1, wherein the switch is an SPDT micro switch.

7. The latch of claim 1, wherein the spring is a compression spring positioned to extend between a surface of the housing and a surface of the trigger.

8. The latch of claim 1, further comprising a sensor positioned to detect when the striker is captured by the latch cam.

9. The latch of claim 8, wherein the sensor comprises a magnetic reed switch.

10. A latch system having a latched configuration and an unlatched configuration, the latch system comprising:

a latch and a striker movable with respect to one another between the latched configuration and the unlatched configuration, the striker having an engagement surface positioned to be engaged by the latch in the latched configuration;

the latch having a latch cam mounted to rotate between a closed position and an open position, the latch cam being biased to rotate toward the open position and capturing the striker when the latch and the striker are in the latched configuration and the latch cam is in the closed position;

a trigger mounted to rotate between a locked position and an unlocked position, fire trigger being biased to rotate toward the locked position and positioned to contact the latch cam when the trigger is in the locked position, thereby retaining the latch cam in the closed position;

a drive cam having at least one cam surface positionable to contact the trigger;

a motor coupled to the drive cam; and a switch coupled to the motor via a motor circuit, the switch being in a closed state closing the motor circuit when the trigger is engaged with the switch, the motor being configured for separate actuation when the switch is in the closed state and the motor not being configured for separate actuation when the switch is not in the closed state; and a spring for biasing the trigger toward the locked position of the trigger;

wherein in the closed state of the switch and upon the separate actuation of the motor, the motor rotates the drive cam, thereby urging the trigger from the locked position toward the unlocked position, disengaging the trigger from the latch cam and from the switch with the drive cam engaging the switch to maintain the closed state of the switch, allowing the latch cam to rotate from the closed position toward the open position, and moving the latch from the latched condition toward the unlatched condition.

11. The latch system of claim 10, further comprising a housing at least partially enclosing one or more of the latch cam, the trigger, the drive cam, the motor, and the switch.

12. The latch system of claim 11, wherein the trigger includes an extension that extends outside of the housing and is configured such that a force applied to the extension urges the trigger toward the unlocked position.

13. The latch system of claim 12, further comprising a cable coupled to the extension of the trigger and a cable mounting bracket receiving the cable.

14. The latch system of claim 10, wherein a bearing surface of the latch cam prevents the trigger from returning to the locked position when the latch cam is in the open position.

15. The latch system of claim 10, wherein the switch is an SPDT micro switch.

16. The latch system of claim 10, wherein the spring is a compression spring positioned to extend between a surface of the housing and a surface of the trigger.

17. The latch system of claim 10, further comprising a sensor positioned to sense when the striker is in proximity to the latch.

18. The latch system of claim 17, wherein the sensor comprises a magnetic reed switch.

19. The latch system of claim 10, wherein the latch is stationary and the striker is movable with respect to the latch.

20. The latch system of claim 10, wherein the striker s stationary and the latch is movable with respect to the striker.

21. The latch system of claim 10, wherein latch status is indicated based on the state of the switch, an open switch indicating that the latch is not secure and a closed switch indicating that the hitch is secure.

* * * * *